US009262891B2

(12) United States Patent
Tessmer

(10) Patent No.: US 9,262,891 B2
(45) Date of Patent: Feb. 16, 2016

(54) METHOD AND APPARATUS FOR DYNAMICALLY SELECTING A MULTIPLIER AND DYNAMICALLY APPLYING THE MULTIPLIER TO A LIMITED NUMBER OF PAYLINES AMONG A PLURALITY OF PRE-DEFINED PAYLINES

(71) Applicant: MTD Gaming, Inc., Highlands Ranch, CO (US)

(72) Inventor: Michael T. Tessmer, Bozeman, MT (US)

(73) Assignee: MTD Gaming, Inc., Highlands Ranch, CO (US)

( * ) Notice: Subject to any disclaimer, the term of this patent is extended or adjusted under 35 U.S.C. 154(b) by 1 day.

(21) Appl. No.: 13/874,114

(22) Filed: Apr. 30, 2013

(65) Prior Publication Data

US 2014/0323200 A1 Oct. 30, 2014

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3244* (2013.01)

(58) Field of Classification Search

CPC ..... G07F 17/32
USPC ..... 463/20
IPC ..... G07F 17/32
See application file for complete search history.

(56) References Cited

U.S. PATENT DOCUMENTS

| | | | | |
|---|---|---|---|---|
| 6,033,307 | A * | 3/2000 | Vancura | 463/20 |
| 6,319,124 | B1 | 11/2001 | Baerlocher et al. | |
| 6,558,254 | B2 | 5/2003 | Baerlocher et al. | |
| 6,692,356 | B2 | 2/2004 | Baerlocher et al. | |
| 6,869,360 | B2 | 3/2005 | Marks et al. | |
| 7,749,073 | B2 | 7/2010 | Thomas et al. | |
| 8,152,616 | B2 * | 4/2012 | Moody | 463/13 |
| 8,177,622 | B2 | 5/2012 | Englman | |
| 8,272,938 | B2 * | 9/2012 | Gilmore et al. | 463/20 |
| 2002/0032050 | A1 | 3/2002 | Baerlocher et al. | |
| 2003/0045345 | A1 * | 3/2003 | Berman | 463/20 |
| 2003/0054875 | A1 | 3/2003 | Marks et al. | |
| 2003/0125106 | A1 | 7/2003 | Baerlocher et al. | |
| 2005/0037836 | A1 | 2/2005 | Gilmore et al. | |
| 2008/0032784 | A1 | 2/2008 | Englman | |
| 2008/0096625 | A1 | 4/2008 | Thomas et al. | |
| 2012/0190438 | A1 | 7/2012 | Bartosik et al. | |

* cited by examiner

*Primary Examiner* — Omkar Deodhar
(74) *Attorney, Agent, or Firm* — Muskin & Farmer LLC

(57) ABSTRACT

A gaming method for adding a bonus feature to a main game comprising: providing a display screen comprised of cells arranged in rows and columns; providing a plurality of paylines, each payline comprising one cell from a plurality of columns; automatically and randomly selecting a multiplier value from among a plurality of multiplier values; automatically and randomly applying the selected multiplier value to a limited number of paylines to create one or more selected multiplier paylines; and displaying the multiplier value and the selected multiplier payline(s) to the user on the display screen.

4 Claims, 5 Drawing Sheets

BASE AWARD TABLE INFORMATION

Stated pay-line award values calculated at 25 Credits Bet and indicated in credits
For other bets, apply pay-line multiple values to award table values to determine award; Bet 50-2x, Bet 100-4x, Bet 150-6x or Bet 200-8x multiple.

| Symbols | | | | | | | | |
|---|---|---|---|---|---|---|---|---|
| 5 of a Kind | 399 | 250 | 200 | 150 | 125 | 100 | 75 | 75 |
| 4 of a Kind | 175 | 75 | 50 | 30 | 25 | 20 | 15 | 10 |
| 3 of a Kind | 15 | 10 | 5 | 5 | 5 | 5 | 5 | 5 |
| 2 of a Kind | 2 | 2 | | | | | | |

WILD substitutes for all symbols, excluding multipliers & are on reels 2 & 3 only.

NEXT BACK
RETURN TO GAME

*Fig. 5*

METHOD AND APPARATUS FOR DYNAMICALLY SELECTING A MULTIPLIER AND DYNAMICALLY APPLYING THE MULTIPLIER TO A LIMITED NUMBER OF PAYLINES AMONG A PLURALITY OF PRE-DEFINED PAYLINES

BACKGROUND OF THE INVENTION

1. Field of the Invention

The present invention relates generally to the field of gaming and, more specifically, to a method and apparatus for gaming that enhances the player experience by automatically and randomly selecting a multiplier and automatically and randomly applying the multiplier to a single payline—or up to no more than ten percent (10%) of the total number of paylines—among a plurality of paylines at the start of each game. All paylines are created equal. The paylines are pre-defined by the system, and each payline has the same odds of occurrence (payouts/wins) and functionality as the other paylines. No user input is required for selection of the multiplier or selection of the payline(s) to which the multiplier is applied.

2. Description of the Related Art

Gaming machine manufacturers are currently challenged with creating anticipation and excitement for the player with their gambling features. Many of the current popular gambling machines have a matrix of symbols with multiple paylines or combinations of ways to win with some sort of bonus feature as the main event that increases the odds of winning for the player during that mode. During the bonus mode, the game likely has increased odds to bigger awards and a higher payback percentage to the player, as well as additional game features that create more excitement. These additional game features may or may not include variations on the main game. For example, bonus features that would be considered variations on the main game include award multipliers, increased odds of getting wilds or other valuable symbols, and free games. One example of a bonus feature that would not be considered a variation on the main game is providing a series of "pick" screens where the player picks an object from several objects, and an award value is given. Another example of a bonus feature that would not be considered a variation on the main game is allowing the player to trigger a spin of a wheel with prizes on each segment and awarding the player the value of the segment to which the wheel indicator points when it stops spinning. The present invention would be considered a bonus-type feature that is ongoing (continuous) in the main game.

Many of the popular mainstream gaming machines have multiple paylines (ways to win) with the bet being spread over these many paylines. Because the bet is spread over these multiple ways to win, any one payline win may not result in a very meaningful award. It is fairly typical for a lot of games to be played and money lost (by the player) during the non-bonus mode. As a result, the challenge to gaming manufacturers is to design a game that maintains the player's attention during the base/main game by providing the perception that awards mat are more frequent and/or more attainable. The present invention ensures that the player continues to be entertained during the main game due to the constant anticipation of hitting a multiplier payline with a relatively generous payout.

The present invention creates anticipation at game start because the player knows that a multiplier will be applied in every game and that this multiplier may be relatively large (e.g., 25×). This makes the player feel that there is potential for a meaningful award on a single payline in every game played in a multi-payline game. The present invention makes the multiplier value and multiplier payline clear to the player at game start, which makes it easy for the player to identify the conditions that will lead to enhanced winnings. Because the multiplier is applied to a relatively small percentage of the total number of paylines (preferably, no more than ten percent (10%)), the gaming manufacturer can offer a large range of multipliers (for example, from 4× to 25×). The fact that the paylines are pre-defined by the system and that all paylines are created equal (i.e., each payline has the same odds of occurrence (payouts/wins) and functionality as the other paylines) also increases player trust.

There are a number of multiplier-type gaming methods, none of which both dynamically selects the multiplier and applies it to a dynamically selected and pre-defined payline (or a limited number of pre-defined paylines) at the start of the game. These include U.S. Pat. No. 6,319,124 (Baerlocher et al., 2001) (applying enhancements to certain reel symbols or their backgrounds); U.S. Pat. No. 6,558,254 (Baerlocher et al., 2003) (applying enhancements to certain symbols or their backgrounds); U.S. Pat. No. 6,692,356 (Baerlocher et al., 2004); U.S. Pat. No. 6,869,360 (Marks et al., 2005) (displaying an active border that at least partially surrounds a game matrix and is configured to randomly select and display game and payline multipliers); U.S. Pat. No. 7,349,073 (Thomas et al., 2010) (allowing players to select paylines to define active paylines; allowing players to activate enhanced paylines; randomly selecting a game outcome in response to a wager input and displaying the game outcome as symbols aligned along the active paylines and the enhanced payline); U.S. Pat. No. 8,152,616 (Moody, 2012) (assigning a randomly selected multiplier to activated paylines); U.S. Pat. No. 8,177,622 (Englman, 2012) (in response to a winning outcome, awarding a player a winning award, modifying the background of a cell associated with the winning outcome, and causing an alteration in the wagering game upon modification of the background); U.S. Pat. No. 8,272,938 (Gilmore et al., 2012) (invoking a win multiplier feature when a displayed combination yields a predetermined award and meets a predetermined criterion).

It is an object of the present invention to create the perception in the mind of the player that a meaningful award can be applied and that meaningful awards are attainable during every game play. It is another object of the present invention to introduce a greater degree of unpredictability (and, therefore, excitement) into the game by providing a large range of multipliers (which can only be done if the multipliers are applied to no more than a limited number of paylines). It is yet another object of the present invention to display a dynamic (i.e., automatically and randomly selected) multiplier on the screen at game start and to visually connect that multiplier to a specific "multiplier" payline that is also dynamically selected from among all of the available paylines.

BRIEF SUMMARY OF THE INVENTION

The present invention is a gaming method for adding a bonus feature to a main game comprising: providing a gaming machine with a display screen, wherein the display screen is comprised of a plurality of cells arranged in rows and columns; providing a plurality of paylines, wherein each payline comprises one cell from a plurality of columns on the display screen; automatically and randomly selecting a multiplier value from among a plurality of multiplier values; automatically and randomly applying the selected multiplier value at game start to a single payline to create a selected multiplier payline, wherein all of the paylines in the plurality of paylines automatically qualify for multiplier status, wherein all of the paylines in the plurality of paylines are automatically activated in the main game; and displaying the multiplier value and the selected multiplier payline to the user on the display screen. In a preferred embodiment, the selected multiplier payline is highlighted with a border around the cells that comprise the selected multiplier payline. Preferably, the selected multiplier value is displayed in the left-most cell of the selected multiplier payline.

In an alternate embodiment, the present invention is a gaming method for adding a bonus feature to a main game comprising: providing a gaming machine with a display screen, wherein the display screen is comprised of a plurality of cells arranged in rows and columns; providing a given number of paylines, wherein each payline comprises one cell from a plurality of columns on the display screen; automatically and randomly selecting a multiplier value from among a plurality of multiplier values; automatically and randomly applying the selected multiplier value at game start to a limited number of paylines in the given number of paylines to create at least two selected multiplier paylines, the limited number being no greater than ten percent (10%) of the given number of paylines, wherein all of the paylines in the given number of paylines automatically qualify for multiplier status, and wherein all of the paylines in the given number of paylines are automatically activated in the main game; and displaying the multiplier value and the selected multiplier paylines to the user on the display screen. In a preferred embodiment, the selected multiplier payline is highlighted with a border around the cells that comprise the selected multiplier payline. Preferably, the selected multiplier value is displayed in the left-most cell of the selected multiplier payline.

In an alternate embodiment, the present invention is a gaming method for adding a bonus feature to a main game comprising: providing a gaming machine with a display screen, wherein the display screen is comprised of a plurality of cells arranged in rows and columns; providing a plurality of paylines, wherein each payline comprises one cell from a plurality of columns on the display screen; automatically and randomly applying a multiplier value at game start to a single payline to create a selected multiplier payline, wherein all of the paylines in the plurality of paylines automatically qualify for multiplier status, wherein all of the paylines in the plurality of paylines are automatically activated in the main game; and displaying the multiplier value and the selected multiplier payline to the user on the display screen.

In another alternate embodiment, the present invention is a gaming method for adding a bonus feature to a main game comprising: providing a gaming machine with a display screen, wherein the display screen is comprised of a plurality of cells arranged in rows and columns; providing a given number of paylines, wherein each payline comprises one cell from a plurality of columns on the display screen; automatically and randomly applying a multiplier value at game start to a limited number of paylines in the given number of paylines to create at least two selected multiplier paylines, the limited number being no greater than ten percent (10%) of the given number of paylines, wherein all of the paylines in the given number of paylines automatically quality for multiplier status, and wherein all of the paylines in the given number of paylines are automatically activated in the main game; and displaying the multiplier value and the selected multiplier paylines to the user on the display screen.

In another alternate embodiment, the present invention is a gaming method for adding a bonus feature to a main game comprising: providing a gaming machine with a display screen, wherein the display screen is comprised of a plurality of cells arranged in rows and columns; providing a given number of paylines, wherein each payline comprises one cell from a plurality of columns on the display screen; automatically and randomly selecting at least two multiplier values from among a plurality of multiplier values; automatically and randomly applying the selected multiplier values at game start to a limited number of paylines in the given number of paylines to create at least two selected multiplier paylines, the limited number being no greater than ten percent (10%) of the given number of paylines, wherein all of the paylines in the given number of paylines automatically qualify for multiplier status, and wherein all of the paylines in the given number of paylines are automatically activated in the main game; and displaying the multiplier values and the selected multiplier paylines to the user on the display screen.

In a preferred embodiment, the multiplier value and the selected multiplier payline are displayed to the user on the display screen at game start. In another preferred embodiment, the multiplier value and the selected multiplier paylines are displayed to the user on the display screen at game start. In yet another preferred embodiment, the multiplier values and the selected multiplier paylines are displayed to the user on the display screen at game start.

The present invention is also a gaming apparatus comprising: a display device; an input device; a processor; and a memory device that stores a plurality of instructions that, when executed by the processor, cause the processor to operate with the display device and the input device to: provide a display screen that is comprised of a plurality of cells arranged in rows and columns; provide a plurality of paylines, each payline comprising one cell from a plurality of columns on the display screen; automatically and randomly select a multiplier value from among a plurality of multiplier values; automatically and randomly apply the selected multiplier value at game start to a single payline to create a selected multiplier payline, wherein all of the paylines in the plurality of paylines automatically qualify for multiplier status, wherein all of the paylines in the plurality of paylines are automatically activated in the main game; and display the multiplier value and the selected multiplier payline to the user on the display screen. In a preferred embodiment, the selected multiplier payline is highlighted with a border around the cells that comprise the selected multiplier payline. Preferably, the selected multiplier value is displayed in the left-most cell of the selected multiplier payline.

In an alternate embodiment, the present invention is a gaming apparatus comprising: a display device; an input device; a processor; and a memory device that stores a plurality of instructions that, when executed by the processor, cause the processor to operate with the display device and the input device to: provide a display screen that is comprised of a plurality of cells arranged in rows and columns; provide a given number of paylines, each payline comprising one ceil from a plurality of columns on the display screen; automatically and randomly select a multiplier value from among a plurality of multiplier values; automatically and randomly apply the selected multiplier value at game start to a limited number of paylines in the given number of paylines to create at least two selected multiplier paylines, the limited number being no greater than ten percent (10%) of the given number of paylines, wherein all of the paylines in the given number of paylines automatically qualify for multiplier status, and wherein all of the paylines in the given number of paylines are automatically activated in the main game; and display the multiplier value and the selected multiplier paylines to the user on the display screen. In a preferred embodiment, the selected multiplier payline is highlighted with a border around the cells that comprise the selected multiplier payline. Preferably, the selected multiplier value is displayed in the left-most cell of the selected multiplier payline.

In an alternate embodiment, the present invention is a gaming apparatus comprising: a display device; an input device; a processor; and a memory device that stores a plurality of instructions that, when executed by the processor, cause the processor to operate with the display device and the input device to: provide a display screen that is comprised of a plurality of cells arranged in rows and columns; provide a plurality of paylines, each payline comprising one cell from a plurality of columns on the display screen; automatically and randomly apply a multiplier value at game start to a single payline to create a selected multiplier payline, wherein all of the paylines in the plurality of paylines automatically qualify tor multiplier status, wherein all of the paylines in the plurality of paylines are automatically activated in the main game; and display the multiplier value and the selected multiplier payline to the user on the display screen.

In another alternate embodiment, the present invention is a gaming apparatus comprising: a display device; an input device; a processor; and a memory device that stores a plurality of instructions that, when executed by the processor, cause the processor to operate with the display device and the input device to: provide a display screen that is comprised of a plurality of cells arranged in rows and columns; provide a given number of paylines, each payline comprising one cell from a plurality of columns on the display screen; automatically and randomly apply a multiplier value at game start to a limited number of paylines in the given number of paylines to create at least two selected multiplier paylines, the limited number being no greater than ten percent (10%) of the given number of paylines, wherein all of the paylines in the given number of paylines automatically qualify for multiplier status, and wherein all of the paylines in the given number of paylines are automatically activated in the main game; and display the multiplier value and the selected multiplier paylines to the user on the display screen.

In another alternate embodiment, the present invention is a gaming apparatus comprising: a display device; an input device; a processor; and a memory device that stores a plurality of instructions that when executed by the processor, cause the processor to operate with the display device and the input device to: provide a display screen that is comprised of a plurality of cells arranged in rows and columns; provide a given number of paylines, each payline comprising one cell from a plurality of columns on the display screen; automatically and randomly select at least two multiplier values from among a plurality of multiplier values; automatically and randomly apply the selected multiplier values at game start to a limited number of paylines in the given number of paylines to create at least two selected multiplier paylines, the limited number being no greater than ten percent (10%) of the given number of paylines, wherein all of the paylines in the given number of paylines automatically qualify for multiplier status, and wherein all of the paylines in the given number of paylines ate automatically activated in the main game; and display the multiplier values and the selected multiplier paylines to the user on the display screen.

In a preferred embodiment, the multiplier value and the selected multiplier payline are displayed to the user on the display screen at game start. In another preferred embodiment, the multiplier value and me selected multiplier paylines are displayed to the user on the display screen at game start. In yet another preferred embodiment, the multiplier values and the selected multiplier paylines are displayed to the user on the display screen at game start.

BRIEF DESCRIPTION OF THE DRAWINGS

FIG. 5 is a diagram of a screenshot showing the Base Award Table.

REFERENCE NUMBERS

1 Display screen
2 Cell
3 Symbol
4 Payline
5 Multiplier

DETAILED DESCRIPTION OF INVENTION

Figure 1:
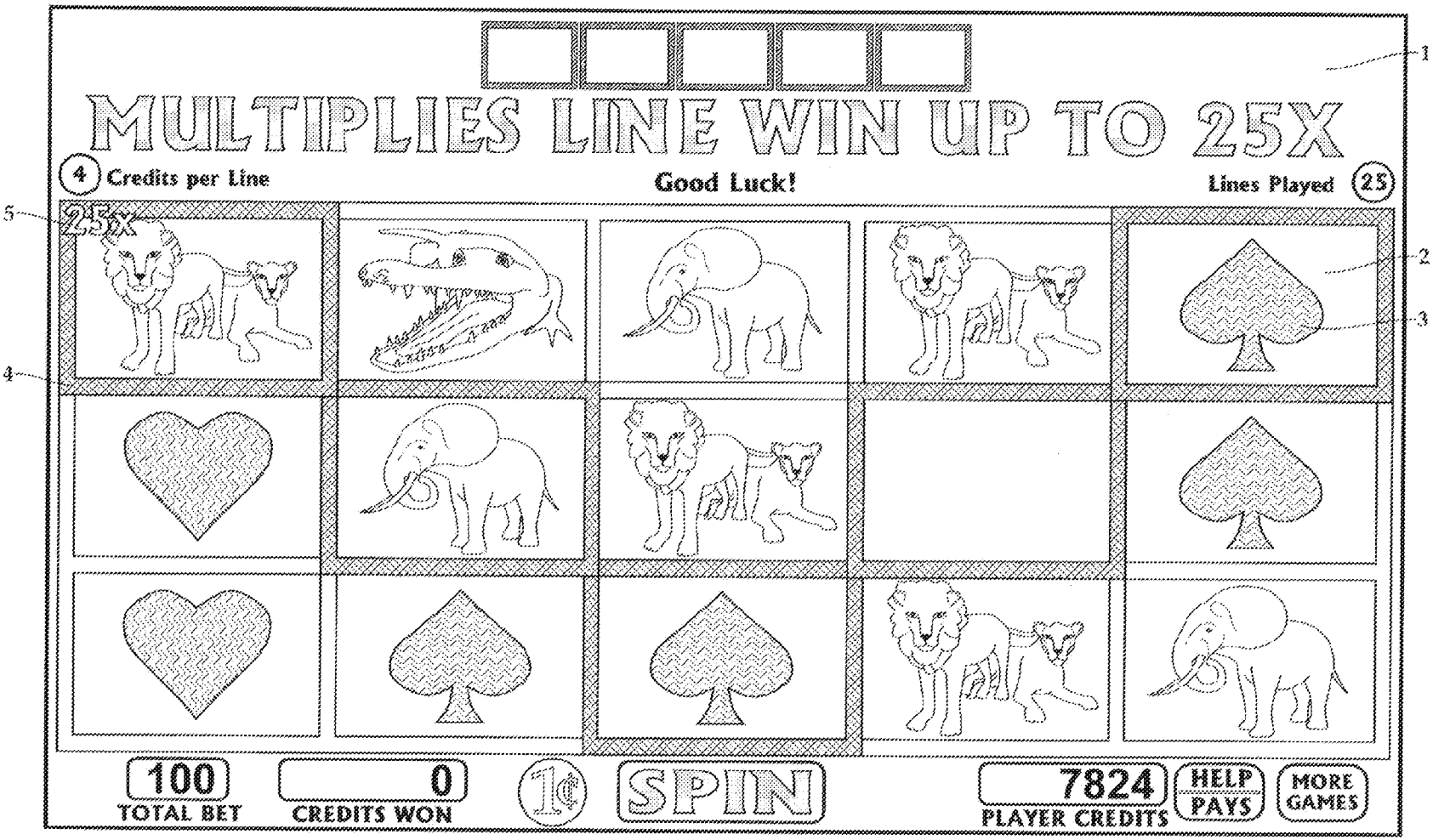
FIG. 1 is a diagram of a screenshot before game start showing the randomly selected multiplier payline.

As shown in FIG. 1, the display screen 1 is comprised of a plurality of cells 2 arranged in rows and columns. Each cell 2 contains a symbol 3. The columns function as "reels" that spin (rotate vertically) at game start. When each reel has finished spinning, the game is completed, and the player wins or loses based on the combination of symbols appearing in the cells 2. A payline 4 is comprised of one symbol 3 from each of the columns in the display screen 1. In the example shown in FIG. 1, there are three rows and five columns; however, the present invention is not limited to any particular number of rows or columns.

FIG. 5 (Base Award Table) provides an example of what is needed to constitute a winning payline. For example, two alligators or two spades would not constitute a winning payline, but two elephants (or two lions) would. Five elephants results in more credits than five bells. The credits corresponding to five-of-a-kind, four-of a-kind, three-of-a-kind and two-of-a-kind for each of the eight symbols are presented in FIG. 5. The present invention is not limited to any particular type or number of symbols, nor is it limited to any particular formula for ascribing points to a particular combination of symbols.

Figure 4:
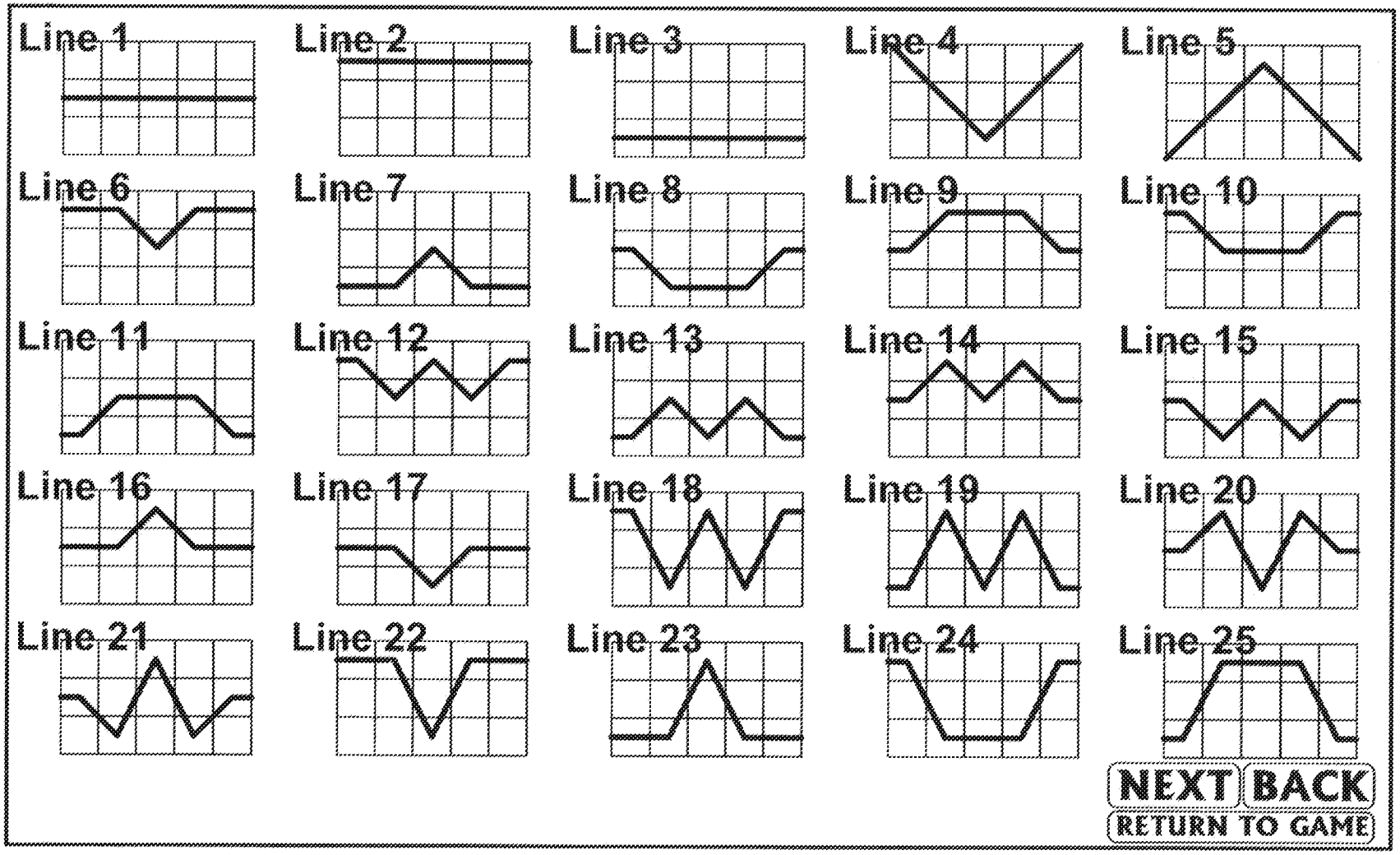
FIG. 4 is a diagram of a screenshot showing twenty-live (25) paylines in a 25-payline game.

FIG. 4 provides an example of a game with twenty-five (25) different paylines. As shown in this figure, each payline comprises one symbol from each of the five columns (or reels). In a preferred embodiment, the paylines are pre-programmed and are not individually definable by the user. To achieve a winning payline, the player must get three-, four- or five-of-a-kind of any of the eight symbols, or two-of-a-kind of the first two symbols (elephant and lion). The repeating symbols must be adjacent to one another in the payline (e.g., a spade in each of columns 1, 2 and 3 in the rows corresponding to the payline) to count as five-, four-, three- or two-of-a-kind.

Referring back to FIG. 1, there is no winning payline because none of the twenty-five (25) paylines shown in FIG. 4 meets the criteria set forth in FIG. 5 (Base Award Table). At game start, the invention highlights one and only one of the paylines as the "multiplier" payline and displays a multiplier 5 (in this case, 25×) in the left-most column (or reel) of that payline. The multiplier may be displayed anywhere on the screen, as long as it is clear to the player that the multiplier applies to the highlighted payline (the multiplier is preferably indicated at the start of the payline, as shown). The "multiplier" payline may be highlighted in any manner that makes it clearly visible to the player at game start.

Displaying the multiplier and highlighting, the multiplier payline is concurrent with the player starting the game. The player initiates the game (typically by pressing a button on the screen, or on the gaming machine console), and all reels spin. The "multiplier" payline preferably stays highlighted during the spinning of the reels and upon completion of the game (until the next game is commenced). FIG. 1 shows what the screen would look like if the player did not win anything at all. In other words, in this screenshot, not only did the player not win on the "multiplier" payline, hut he did not win on any of the twenty-four (24) other paylines shown in FIG. 4.

Note that the "multiplier" payline shown in FIG. 1 is payline number 4 (in FIG. 4). In the present invention, all of the paylines in a game are capable of being selected as the "multiplier" payline, and the invention automatically and randomly selects the multiplier payline at the start of each game. (The multiplier payline is shown to the player by highlighting that particular payline on the screen, as shown in FIG. 1.) This feature adds greater interest to the game because the payline to which the multiplier is applied varies. No action or intervention from the player is necessary to activate a payline or to qualify it for "multiplier" status. In a preferred embodiment, the player is required to play all paylines; in other words, he cannot select fewer than all of the available paylines to play in a given game, nor can he select which paylines will qualify for multiplier status or to which payline(s) the multiplier will apply. Instead, the system automatically treats all paylines as qualified for multiplier status and automatically and randomly selects the payline to which the multiplier will apply. Unlike some of the prior art references, no user intervention (other than placing the initial minimum wager) is required to "activate" any given paylines or to qualify them for multiplier status (everything happens automatically at game start), and the paylines that qualify for multiplier status are the same paylines that are used (automatically activated) in the main game.

Figure 2:
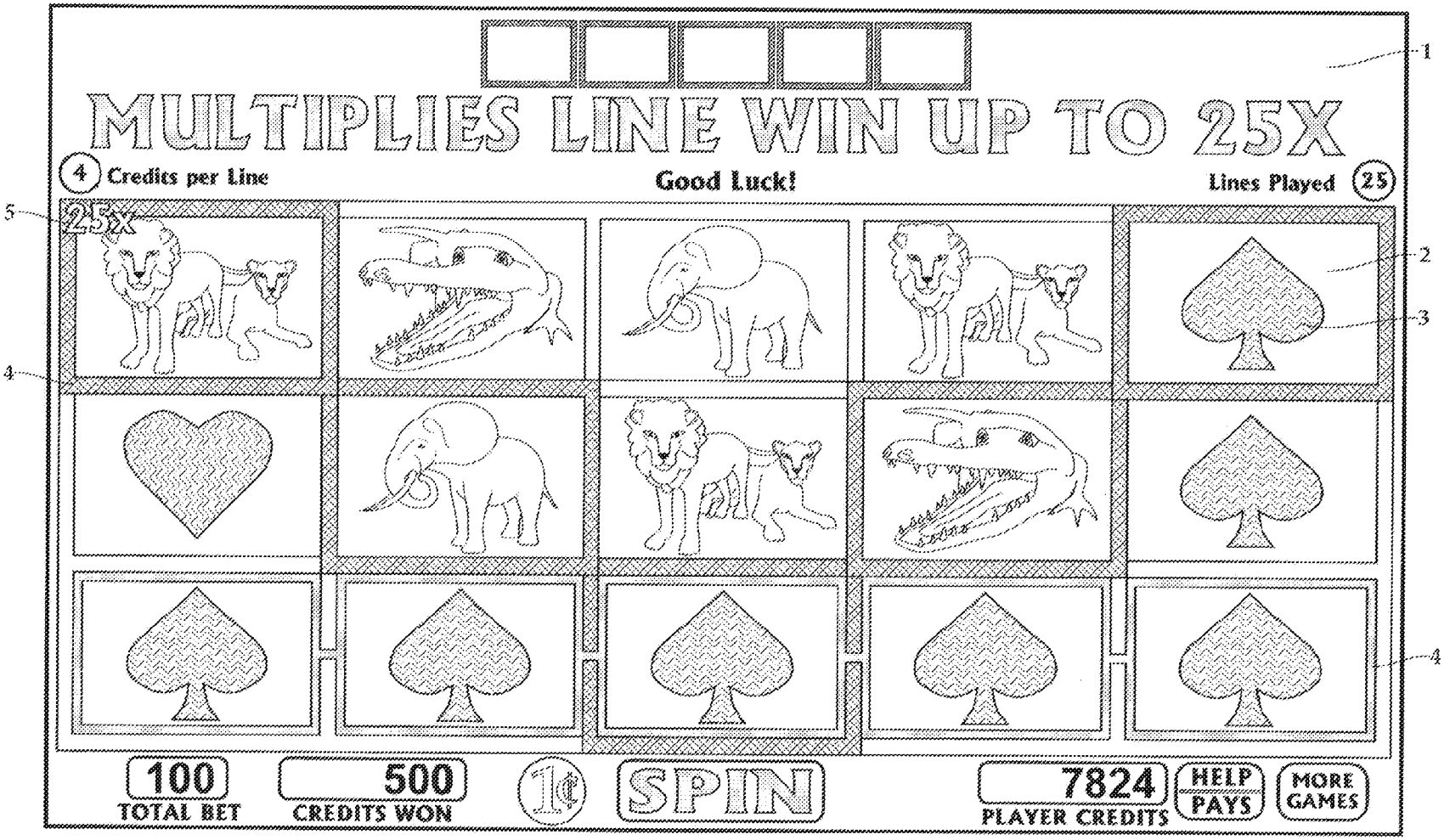
FIG. 2 is a diagram of a screenshot after a game has been played showing a winning payline that is not the multiplier payline.

In FIG. 2, the game has resulted in a winning payline (in this case, payline 3 on FIG. 4), but the winning payline is not the "multiplier" payline, which remains highlighted. In the example shown in FIG. 2, the winning payline is indicated with a line that extends through the middle of each cell in the winning payline; however, the present invention is not limited to any particular way of designating a winning payline. In this case, the winner would earn the number of credits indicated on the Base Award Table (FIG. 5) without any multiplier.

Figure 3:
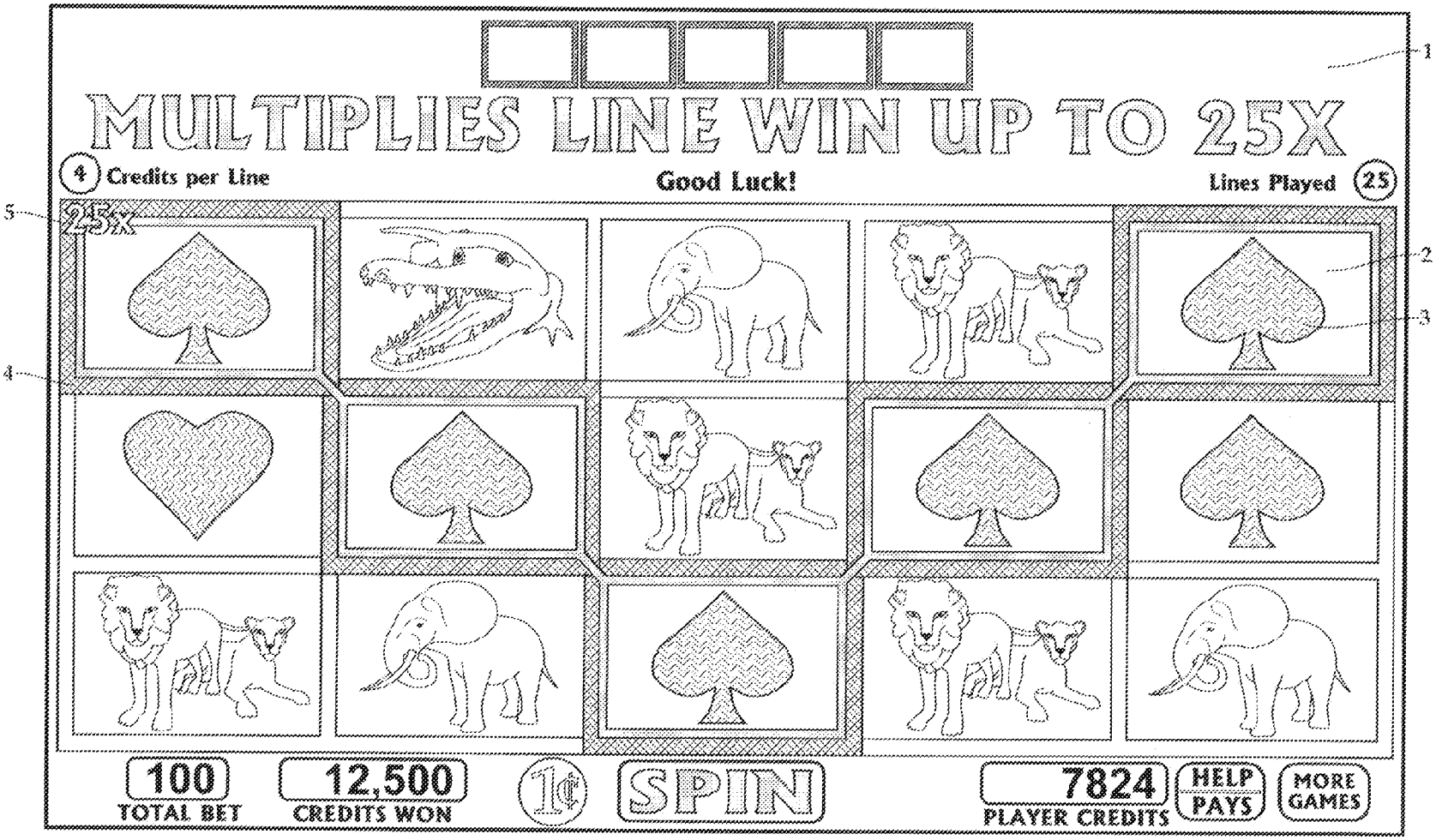
FIG. 3 is a diagram of a screenshot after a game has been played showing a winning payline that is also the multiplier payline.

In FIG. 3, the game has resulted in a winning payline that is also the "multiplier" payline (that is, the same payline that is highlighted in FIG. 1). In this case, the winner would earn the number of credits indicated on the Base Award Table (FIG. 5) multiplied by the multiplier value, which in this example is 25. The present invention automatically and randomly selects the multiplier value (from a variety of multiplier values) that is applied at the start of each game. As used herein the term "dynamically" (in reference to both the selection of the multiplier from among a plurality of multiplier values and the selection of the multiplier payline from among a plurality of pre-defined paylines) means both automatically and randomly. In a preferred embodiment, animation is used to highlight a winning multiplier payline.

With regard to "credits won" (in the lower left-hand corner of the display screen in FIGS. 1-3), these credits are calculated by the system based on the bet placed by the player, the particular combination of symbols in the winning payline (based on the Base Award Table shown in FIG. 5), and whether the winning payline is a multiplier payline. For example, referring to FIG. 1, the credits won is zero. This is because there is no winning payline. Referring to FIG. 2, the credits won are 500. This is because the winning payline (in this case, payline "3" shown in FIG. 4) contains five spades. According to the Base Award Table, five adjacent spades in a payline are worth 125 credits. The "Credits per Line" in the upper left-hand corner of the display screen indicates how many credits per line the player has bet. In this case, the player has bet 4 credits per line; therefore, the winning payline shown is actually worth 500 credits (125 times four). Referring to FIG. 3, the winning payline (in this case, payline "4" shown in FIG. 4) contains five spades, but it is also the multiplier payline. The multiplier is "25×"; therefore, the total credits won by the player is actually 12,500 (500 times 25).

Note that although the above examples apply the multiplier to a single payline, in an alternate embodiment, the multiplier may be applied to up to no more than ten percent (10%) of the total number of paylines. For example, in a game in which there are a total of 25 different paylines (as shown in FIG. 4), the multiplier could be applied to up to two different paylines. In a game with a total of 50 different paylines, the multiplier could be applied to up to five different paylines. It is important to limit the number of paylines to which the multiplier applies to a relatively small number (small in relation to the total number of paylines) in order to keep the game economically feasible. In other words, the fewer the number of paylines to which the multiplier is applied, the greater the multiplier values (e.g., 25×) that can be used. This limitation makes the game more meaningful and exciting for players because the potential rewards of hitting a multiplier payline are greater.

In an alternate embodiment, the system applies a single multiplier to a dynamically selected payline or limited number of paylines. In this embodiment, the multiplier is not dynamically selected. In yet another alternate embodiment, the system dynamically selects more than one multiplier value and applies a multiplier value to each of the paylines in the selected number of paylines; in other words, the same multiplier value is not necessarily applied to each of the selected paylines when there is more than one selected payline. In the latter embodiment, only one multiplier value is applied to each selected payline, although the multiplier values applied to the selected paylines may be different.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A slot machine comprising:

(a) a display device;

(b) an input device;

(c) a processor; and (d) a memory device that stores a plurality of instructions that, when executed by the processor, cause the processor to operate with the display device and the input device to:

(i) provide a display screen that is comprised of a plurality of cells arranged in rows and columns;

(ii) provide a plurality of paylines, each payline comprising one cell from each of a plurality of columns on the display screen;

(iii) automatically and randomly select a multiplier value from among a plurality of multiplier values using an electronic random number generator;

(iv) automatically and randomly apply the selected multiplier value at game start to one and only one payline to create a selected multiplier payline, wherein all of the paylines in the plurality of paylines automatically qualify for multiplier status, wherein all of the paylines in the plurality of paylines are automatically activated in the main game; and (v) display the multiplier value and the selected multiplier payline to the user on the display screen.

2. The slot machine of claim 1, wherein the selected multiplier payline is highlighted with a border around the cells that comprise the selected multiplier payline.

3. The slot machine of claim 1, wherein the selected multiplier value is displayed in the left-most cell of the selected multiplier payline.

4. The slot machine of claim 1, wherein the multiplier value and the selected multiplier payline are displayed to the user on the display screen at game start.

* * * * *